US008826983B2

(12) United States Patent
Huang

(10) Patent No.: US 8,826,983 B2
(45) Date of Patent: Sep. 9, 2014

(54) PLASMA CHARGES

(75) Inventor: Hongfa Huang, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 179 days.

(21) Appl. No.: 13/325,882

(22) Filed: Dec. 14, 2011

(65) Prior Publication Data

US 2012/0168150 A1 Jul. 5, 2012

Related U.S. Application Data

(60) Provisional application No. 61/427,898, filed on Dec. 29, 2010.

(51) Int. Cl.

| | |
|---|---|
| ***E21B 43/11*** | (2006.01) |
| ***E21B 43/117*** | (2006.01) |
| ***F42B 1/028*** | (2006.01) |
| ***F41B 6/00*** | (2006.01) |

(52) U.S. Cl.

CPC ..... *E21B 43/117* (2013.01); *F42B 1/028* (2013.01); *F41B 6/003* (2013.01)

USPC ..... 166/297; 166/55

(58) Field of Classification Search

USPC ..... 166/297, 298, 55, 55.1

See application file for complete search history.

(56) References Cited

U.S. PATENT DOCUMENTS

| | | | | |
|---|---|---|---|---|
| 5,361,843 | A | 11/1994 | Shy et al. | |
| 7,849,919 | B2 * | 12/2010 | Wood et al. | 166/248 |
| 2008/0282924 | A1 | 11/2008 | Saenger et al. | |
| 2009/0133871 | A1 * | 5/2009 | Skinner et al. | 166/250.16 |
| 2009/0183916 | A1 | 7/2009 | Pratt et al. | |

FOREIGN PATENT DOCUMENTS

KR 100316005 B1 2/2002

OTHER PUBLICATIONS

C.A. Hall, J.R. Asay, M.D. Knudson, W.A. Sygar, R. B. Spielman et al., Experimental configuration for isentropic compression of solids using pulsed magnetic loading, 2001 American Institute of Physics—accepted for publication Jun. 24, 2001, vol. 72, No. 9, Sep. 2001, pp. 3587-3595.

D.J. Ampleford, S.V. Lebedev, S.N. Bland, S.C. Bott, J.P. Chittenden, C.A. Jennings, V.L. Kantsyrev, A.S. Safronova, V.V. Ivanov, D.A. Fedin, P.J. Laca, M.F. Yilmaz, V. Nalajala, I. Shrestha, K. Williamson, G. Osborne, A. Haboub, A. Ciardi—Dynamics of conical wire array Z-pinch implosions—2007 American Institute of Physics, Published online Oct. 24, 2007, pp. 102704-1 to 102704-13.

D.R. Farley, K.G. Estabrook, S.G. Glendinning, S.H. Glenzer, B.A. Remington, K. Shigemori, J.M. Stone, R.J. Wallace, G.B. Zimmerman and J.A. Harte—Radiative Jet Experiments of Astrophysical Interest Using Intense Lasers—1999 The American Physical Society, vol. 83, No. 10, Sep. 6, 1999, pp. 1982-1985.

J.P. Chittenden, M. Dunne, M. Zepf, S.V. Lebedev, A. Ciardi, S.N. Bland—Indirect-Drive Inertial Confinement Fusion Using Highly Supersonic, Radiatively Cooled, Plasma Slugs—2002 The American Physical Society, vol. 88, No. 23, Jun. 10, 2002, Published May 21, 2002, pp. 235001-1 to 235001-4.

David Martinez, Radu Presura, Sandra Wright, Chris Plechaty, Stephan Neff, Lucas Wanex, David J. Ampleford—Generation of shear flow in conical wire arrays with a center wire—Astrophys Space Sci, Published online: Nov. 29, 2008.

T. Jaglinski, B.M. Lalone, C. J. Bakeman, Y. M. Gupta—Shockless compression of z-cut quartz to 7 GPa—2009 American Institute of Physics, Published online Apr. 2, 2009, pp. 083528-1 to 083528-6.

* cited by examiner

*Primary Examiner* — William P Neuder

(74) *Attorney, Agent, or Firm* — Jeffery R. Peterson; Brandon Clark

(57) ABSTRACT

Disclosed are plasma charges and methods for using plasma charges in completing a well.

20 Claims, 3 Drawing Sheets

PLASMA CHARGES

CROSS-REFERENCE TO RELATED APPLICATIONS

The present application claims the benefit of priority under 35 U.S.C. §119(e) to U.S. provisional patent application No. 61/427,898, filed on Dec. 29, 2010, the content of which is incorporated herein by reference in its entirety.

BACKGROUND

The present disclosure relates generally to plasma charges and uses thereof, more specifically to the use of plasma charges in well perforation. Perforating devices are often used to complete oil and natural gas wells. Typically, these devices having an array of charges are lowered downhole into a cased well. When the device is at the correct depth in the well, the charges are fired, sending shaped charge jets outward through the side of the device, through any fluid between the device and the well casing, through the well casing, and finally into the oil-bearing or natural-gas bearing rock. The resulting holes in the well casing allow oil or natural gas to flow into the well and to the surface. The remains of the device must then be withdrawn from the well after the charges have been fired.

Conventional shaped charges utilized for well completion are driven by explosive detonation pressure and typically include an explosive and a liner. After the explosive is detonated, the energy from the detonated explosive is transferred to the liner by detonation waves that squeeze liner material to form a jet having a speed on an order of about 5 km/s. The mass of a typically charge jet utilized in oilfield application may be in the order of 10 grams and may have a total kinetic energy on the order of 250 kJ. The performance of a shaped charge in oilfield applications mostly depends on the jet speed, which is limited by the detonation pressure of the current advanced high-energy explosives such as HMX [octogen-octahydro-1,3,5,7-tetranitro-1,3,5,7-tetrazocine], RDX [cyclonite-hexahydro-1,3,5-trinitro-1,3,5-triazine], PETN (Pentaerythritol tetranitrate)[3-Nitrooxy-2,2-bis(nitrooxymethyl)propyl]nitrate, and the like. It is difficult to significantly increase the detonation pressure with current advanced high-energy explosives. Further, explosives present a hazard with respect to manufacture, storage, and transportation.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

Disclosed are plasma charges which may be utilized in well perforation. The plasma charges typically contain metal which is structured to form a plasma jet after the charges are subjected to the pulse of an electromagnetic field.

BRIEF DESCRIPTION OF THE DRAWINGS

Embodiments of plasma charges and uses thereof are described with reference to the following figures. The same numbers are used throughout the figures to reference like features and components.

DETAILED DESCRIPTION

Figure 1:
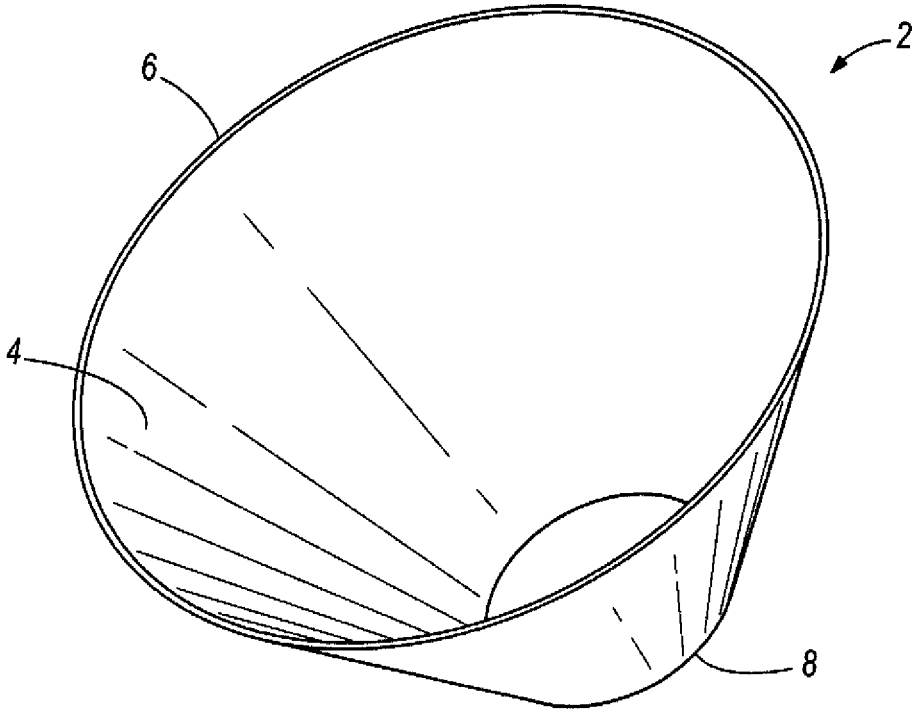
FIG. 1 shows one embodiment of a plasma charge as contemplated herein as an open cone of metal foil.

The following description concerns a number of embodiments and is meant to provide an understanding of the embodiments. The description is not in any way meant to limit the scope of any present or subsequent related claims.

Unless otherwise specified or indicated by context, the terms "a", "an", and "the" mean "one or more."

The terms "about", "approximately," "substantially," and "significantly" will be understood by persons of ordinary skill in the art and will vary to some extent on the context in which they are used. If there are uses of the term which are not clear to persons of ordinary skill in the art given the context in which it is used, "about" and "approximately" will mean plus or minus ≤10% of the particular term and "substantially" and "significantly" will mean plus or minus >10% of the particular term.

The terms "include" and "including" have the same meaning as the terms "comprise" and "comprising."

The terms "above" and "below"; "up" and "down"; "upper" and "lower"; "upwardly" and "downwardly"; and other like terms indicating relative positions above or below a given point or element are used in this description to more clearly describe some embodiments. However, when applied to equipment, systems, and methods for use in wells that are deviated or horizontal, such terms may refer to a left to right, right to left, or diagonal relationship as appropriate.

The term "metal" typically refers to a solid material that is hard, shiny, malleable, fusible, and ductile with good electrical and thermal conductivity. As used herein, metal may refer to a pure metallic element or an alloy comprising two or more non-metallic elements.

Disclosed are plasma charges which may be utilized in well perforation. The plasma charges typically contain metal which is structured to form a plasma jet after the charges are subjected to the pulse of an electromagnetic field. The plasma charge typically includes a comprising a truncated cone having a skirt end, an apex end, and metal traversing from the skirt end to the apex end. In some embodiments, the plasma charge may be utilized in methods or systems for completing a well. The methods may include and the systems may be utilized for: (a) inserting the plasma charge into the well, and (b) applying an electromagnetic field to the plasma charge to generate a plasma jet. In some embodiments, the well comprises a casing and/or a formation and the plasma jet perforates the casing and/or formation.

In some embodiments, the plasma charge includes a non-metal truncated cone and metal ribs traversing from the skirt end to the apex end on an interior surface of the truncated cone. In other embodiments, the truncated cone of the plasma charge is entirely metal.

In the disclosed methods and systems, an electromagnetic field may be applied to the plasma charge in order to generate a plasma jet. In some embodiments, the electromagnetic field may be applied to the plasma charge by contacting the skirt end with an anode and by contacting the apex end with a cathode, for example, by contacting the plasma charge with a capacitor. A current may be passed through the plasma charge.

The disclosed charges typically include a metal component. In some embodiments the metal has a density of less than about 10 g/cm$^3$. For example, the metal may include aluminum, copper, or iron. In other embodiments, the metal has a density of greater than about 10 g/cm$^3$. For example, the metal may include tungsten or tantalum.

The disclosed charges may be utilized to generate a plasma jet having a suitable velocity completing a well (e.g., via perforating a well casing, formation, or both). With respect to velocity, in some embodiments the plasma jet has a velocity of at least about 50, 100, 150, or 200 km/s. With respect to mass, in some embodiments the plasma jet has a mass of at least about 0.05, 0.1, 0.5, 1, or 2 g.

The disclosed charges may be utilized to generate a plasma jet having a suitable length and diameter for completing a well (e.g., via perforating a well casing, formation, or both). With respect to length, in some embodiments the plasma jet has a length of at least about 10, 20, or 40 mm. With respect to diameter, in some embodiments the plasma jet has a diameter of at least about 0.5, 1, or 2 mm.

The disclosed charges further may be utilized in methods and systems as a detonating device, which optionally may be utilized for completing a well (e.g., via perforating a well casing, formation, or both). The disclosed methods may include and the systems may be utilized for: (a) inserting the plasma charge and an explosive into the well; and (b) applying an electromagnetic field to the plasma charge to generate a plasma jet that detonates the explosive.

In some embodiments, the disclosed plasma charges may be utilized in a system for completing a well. The disclosed systems may include: (a) a perforating tool or gun; and (b) a plasma charge mounted in the perforating tool or gun, the charge including a truncated cone having a skirt end, an apex end, and metal traversing from the skirt end to the apex end, such that after the plasma charge is subjected to an electromagnetic field, the plasma charge generates a plasma jet. Optionally, the systems further may include: (c) a power cord for transmitting an electric current to the plasma charge in order to subject the plasma charge to an electromagnetic field. Further, optionally, the systems may include: (d) a charge carrier, where the power cord transmits an electric current from the charge carrier to the plasma charge.

Disclosed are plasma charges that may be utilized to generate a high speed plasma jet, for example, having a speed of at least about 50, 100, or 200 km/s. The plasma jet may be formed by applying a sharp pulse of an electromagnetic field to the plasma charge.

The disclosed plasma charge forms a plasma jet after the charge is subjected to an electromagnetic field, which condenses into matter after cooling. As such, the plasma charge may be utilized as a replacement for explosives in completing a well. Alternatively, the plasma charge may be utilized as a non-explosive detonator for separate explosives.

The plasma charge typically includes a truncated cone having a skirt end, an apex end, and metal traversing from the skirt end to the apex end. In some embodiments, the plasma charge includes a non-metal truncated cone and metal ribs traversing from the skirt end to the apex end on an interior surface of the truncated cone. In other embodiments, the truncated cone is entirely metal. The metal of the plasma charge may be a relatively low density metal having a density of less than about 10 g/cm$^3$ such as aluminum, iron and copper, or a relatively high density metal having a density of less than about 10 g/cm$^3$ such as tantalum and tungsten.

The mass of the plasma jets generated by the presently disclosed charges typically is greater than about 0.05, 0.1, 0.5, 1, or 2 grams (e.g., between about 0.05-2 g) and has a comparable kinetic energy and momentum as the oilfield shaped charge. For example, the plasma jets generated by the charges disclosed herein may have a kinetic energy of at least about 50, 100, 150, 200, or 250 kJ. The kinetic energy of the plasma jet generated by the presently disclosed charges will be proportional to the electromagnetic field to which the charge is subjected in order to generate the plasma jet.

The presently disclosed plasma charges typically do not include explosive material and are charged via electricity. As such, the presently disclosed plasma charges are not explosive or hazardous with respect to manufacturing, storage and transportation. In addition, hardware used to deploy the presently disclosed plasma charges (e.g., a perforating tool or gun) is fundamentally different than conventional hardware, because it does not produce high gas pressure, debris, tool-swelling or tool-splitting. As such, the hardware may be reusable so the cost for consumable perforating hardware is reduced.

Figure 2:
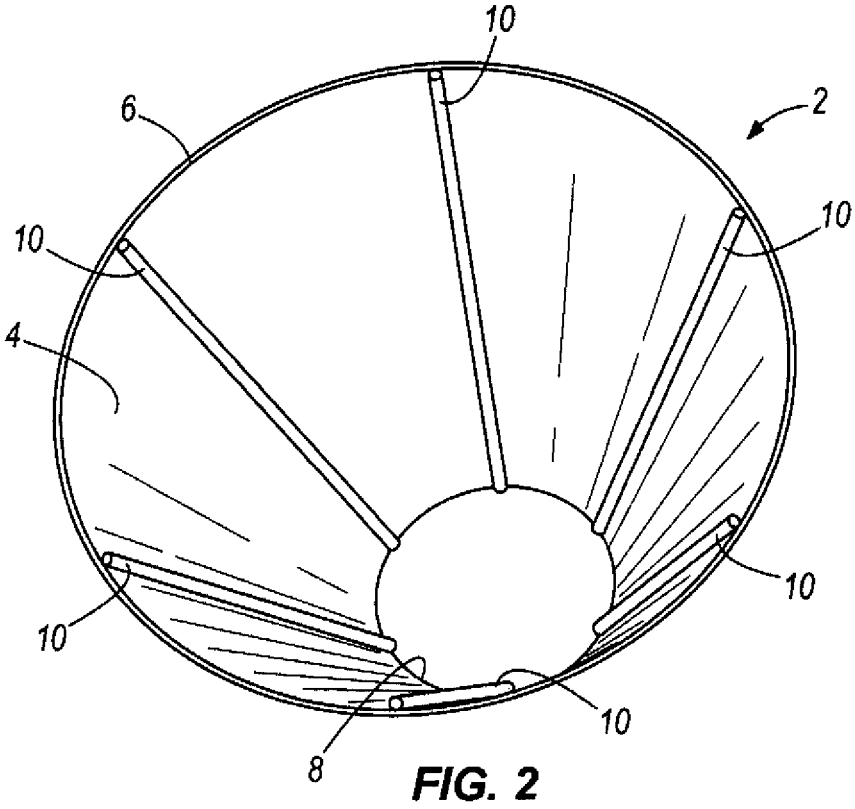
FIG. 2 shows another embodiment of a plasma charge as contemplated herein comprising a non-metal open cone and interior metal ribs.

Referring now to the figures, FIGS. 1 and 2 show truncated conical-shaped charges. In FIG. 1, the charge 2 includes a truncated (i.e. open) metallic cone of thin metal foil that is conductive 4. The metallic cone has a skirt end 6 (i.e., wider end) and an apex end 8 (i.e., the narrower end). In FIG. 2, the charge 2 includes a truncated non-metallic cone 4 that is non-conductive and has a series of metal wires or ribs 10 that are axial-symmetrically positioned from the skirt end of the cone 6 to the apex end of the cone 8.

Figure 3:
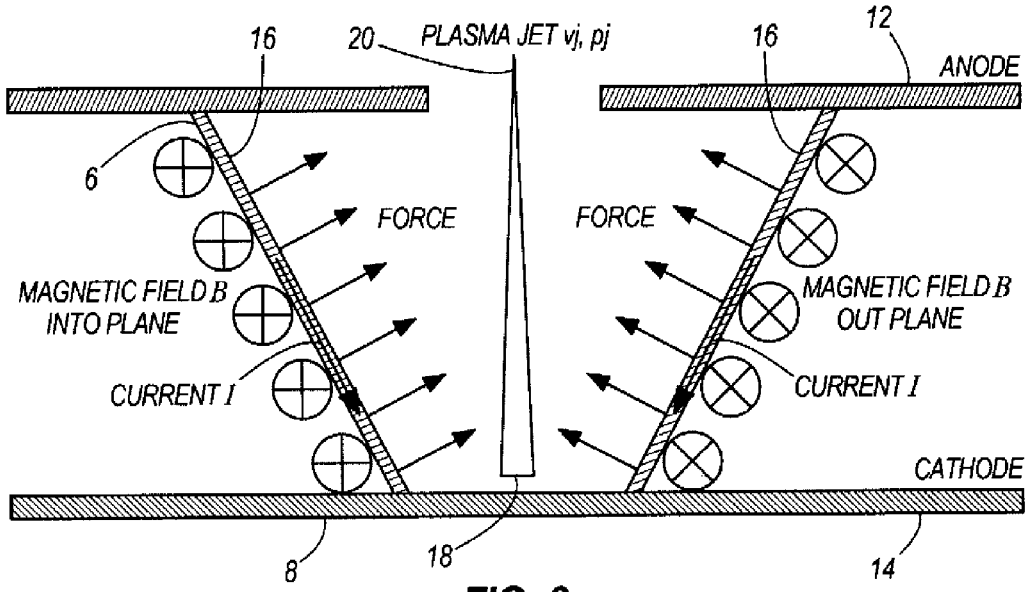
FIG. 3 illustrates applying an electromagnetic field to the plasma charge and generating a Lorenz force on a plasma charge of FIG. 1 or FIG. 2.

As illustrated in FIG. 3, the disclosed plasma charges are able to produce a plasma jet through magneto-hydrodynamics. An anode 12 is contacted with the skirt end of a metallic foil cone 6 (or skirt end of wires positioned on a non-metallic cone) and a cathode 14 is contacted with the apex end of the metallic foil cone 8 (or apex end of wires positioned on a non-metallic cone). A sharp rise of current I in the metallic foil or wires from the skirt end to the apex end heats the conductive component of the charge which is ablated to form plasma at the surface of the metallic foil or wires 16. A continuous flow of current further heats the plasma and generates a strong magnetic field B which causes a Lorentz force (Force) calculated by the equation $F=J\times B$ where J is the current density and B is the magnetic. The Lorentz force thus generated is perpendicular to the surface of the foil/wire and drives the plasma toward a central axis 18. The momentum of the plasma has an axial component (vj) and a radial component (ρj). The collision of the plasma creates a shock that jets plasma forward along the axis, similar to the explosive driven liner forming jet in conventional explosive charges.

The magnetic field B is higher near the cathode 14 which causes a higher Lorenz force (Force) near the cathode. As such, the plasma jet forms first near the cathode 14. The plasma jet subsequently cools and forms a jet of condensed matter as the jet 20 is expelled from the charge. For a conical metal foil charge or a charge having a series of wires, a ¼ inch diameter cathode and a ¾ inch diameter anode for typical ablation velocities will produce a jet exhibiting tens of nanoseconds difference in the flight time between the skirt end and the apex end. In one embodiment of the disclosed charges, the charge includes tungsten metal and produces a jet having a length of at least about 40 mm, having a diameter of at least about 2 mm, and having a speed of at least about 200 km/s.

Figure 4:
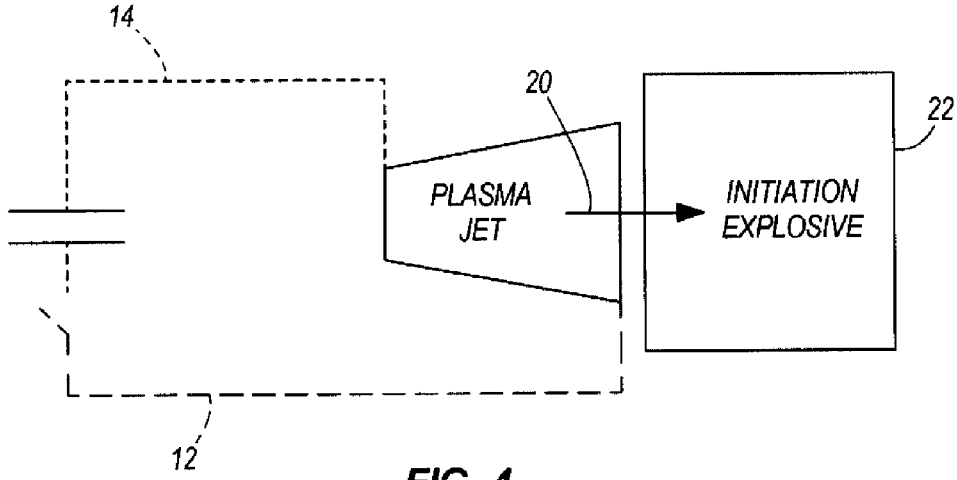
FIG. 4 illustrates a plasma charge utilized to generate a plasma jet via a capacitor where the plasma jet impacts and detonates an initiation explosive.

Referring now to FIG. 4, the disclosed plasma charges may be utilized to detonate explosives. As shown in FIG. 4, a plasma jet 20 generated from a charge via an applied magnetic field as indicated in FIG. 3 contacts and detonates an initiation explosive material 22.

Figure 5:
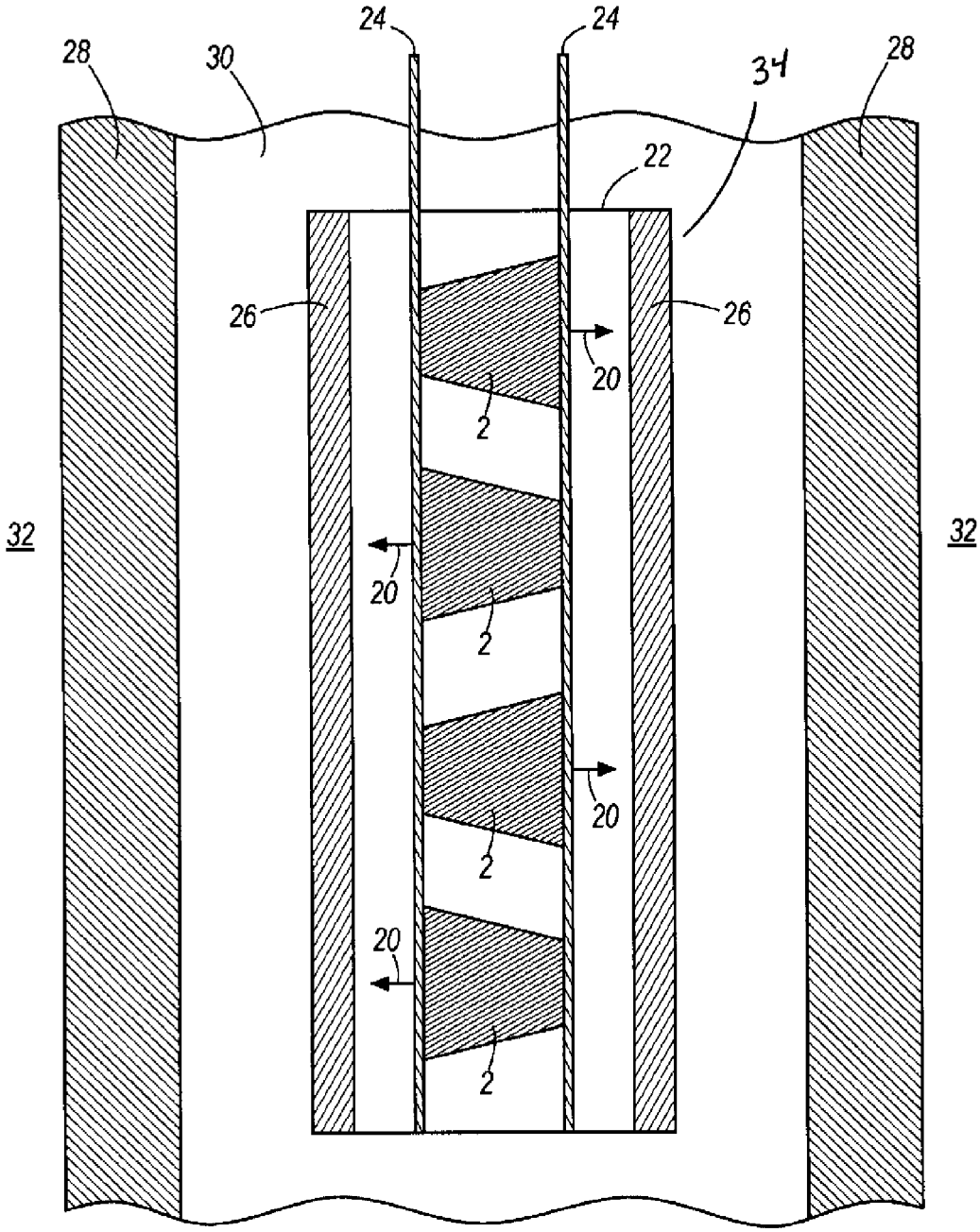
FIG. 5 shows one embodiment of plasma charges as contemplated herein utilized in a perforating gun placed within an oilwell casing.

Referring now to FIG. 5, multiple plasma charges 2 may be utilized in a perforating tool or gun 34 which may include a power cord 24 and a charge carrier 26 (e.g., a capacitor). Plasma jets 20 created via applying a magnetic field to the charges as in FIG. 3 may be utilized to create communication channels between a reservoir formation 32 and a well 30 through a well casing 28. The depth of the penetration tunnel can be selected for optimal production of the well.

In some embodiments, the disclosed plasma charges may be utilized in place of conventional explosives. The disclosed plasma charges may be relatively light in weight as compared to conventional explosive charges because the disclosed plasma charges do not require a charge case which is present in convention charges and is typically made of steel. Further, the disclosed charges do not require explosives or detonation cords which are present in conventional perforating tool systems. Also, the potential for tool swelling or splitting in convention explosive systems are essentially eliminated because high pressure gas is not generated in the disclosed systems.

The disclosed plasma charges may be subjected to a magnetic field via contacting the charges either directly or indirectly with one or more capacitors which may be portable. For example, multiple capacitors may be loaded and transported on a transport vehicle to a well site. The capacitors can be charged with a standard generator present at the well site. In some embodiments, the capacitor may have selected dimensions such that multiple capacitors may be loaded and transported on a single transport vehicle.

In the foregoing description, it will be readily apparent to one skilled in the art that varying substitutions and modifications may be made to the invention disclosed herein without departing from the scope and spirit of the invention. The invention illustratively described herein suitably may be practiced in the absence of any element or elements, limitation or limitations which is not specifically disclosed herein. The terms and expressions which have been employed are used as terms of description and not of limitation, and there is no intention that in the use of such terms and expressions of excluding any equivalents of the features shown and described or portions thereof, but it is recognized that various modifications are possible within the scope of the invention. Thus, it should be understood that although the present invention has been illustrated by specific embodiments and optional features, modification and/or variation of the concepts herein disclosed may be resorted to by those skilled in the art, and that such modifications and variations are considered to be within the scope of this invention. It is the express intention of the applicant not to invoke 35 U.S.C. §112, paragraph 6 for any limitations of any of the claims herein.

Citations to a number of references are made herein. The cited references are incorporated by reference herein in their entireties. In the event that there is an inconsistency between a definition of a term in the specification as compared to a definition of the term in a cited reference, the term should be interpreted based on the definition in the specification.

What is claimed is:

1. A method for completing a well, the method comprising: (a) inserting a plasma charge into the well, the charge comprising a truncated cone having a skirt end, an apex end, and metal traversing from the skirt end to the apex end; and (b) applying an electromagnetic field to the plasma charge to generate a plasma jet.

2. The method of claim 1, wherein the plasma charge comprises a non-metal truncated cone and metal ribs traversing from the skirt end to the apex end on an interior surface of the truncated cone.

3. The method of claim 1, wherein the truncated cone of the plasma charge is entirely metal.

4. The method of claim 1, wherein the electromagnetic field is applied to the plasma charge by contacting the skirt end with an anode and by contacting the apex end with a cathode.

5. The method of claim 1, wherein the metal has a density of less than about 10 g/cm$^3$.

6. The method of claim 1, wherein the metal has a density of greater than about 10 g/cm$^3$.

7. The method of claim 1, wherein the metal comprises aluminum, copper, tungsten or tantalum.

8. The method of claim 1, wherein the plasma jet has a speed of at least about 100 km/s.

9. The method of claim 1, wherein the plasma jet has a mass of at least about 0.05 g.

10. The method of claim 1, wherein the well comprises a casing and the plasma jet perforates the casing.

11. The method of claim 1, wherein the well comprises a formation and the plasma jet perforates the formation.

12. The method of claim 1, wherein the electromagnetic field is applied to the plasma charge by contacting the plasma charge with a capacitor.

13. The method of claim 1, further comprising inserting an explosive into the well wherein the generated plasma charge detonates the explosive.

14. A method for completing a well, the method comprising: (a) inserting a plasma charge into the well, the charge comprising a truncated cone having a skirt end, an apex end, and tungsten metal traversing from the skirt end to the apex end; and (b) applying an electromagnetic field to the plasma charge to generate a tungsten jet.

15. The method of claim 14, wherein the plasma jet has a speed of at least about 200 km/s.

16. The method of claim 14, wherein the plasma jet has a length of at least about 40 mm.

17. The method of claim 14, wherein the plasma jet has a diameter of at least about 2 mm.

18. A system for completing a well, the system comprising: (a) a perforating tool; and (b) one or more plasma charges mounted in the perforating tool, wherein the one or more plasma charges comprise a truncated cone.

19. The system of claim 18, wherein the charge comprises a skirt end, an apex end, and metal traversing from the skirt end to the apex end, wherein after the plasma charge is subjected to an electromagnetic field, the plasma charge generates a plasma jet.

20. The system of claim 19, further comprising: (c) one or more power cords for transmitting an electric current to the plasma charge in order to subject the plasma charge to an electromagnetic field; and (d) one or more charge carriers, wherein the one or more power cords transmit an electric current from the one or more charge carriers to the one or more plasma charges.

* * * * *